US009867401B1

(12) United States Patent
Utecht

(10) Patent No.: US 9,867,401 B1
(45) Date of Patent: Jan. 16, 2018

(54) SHOWER SOCK

(71) Applicant: Ben Utecht, Lakeville, MN (US)

(72) Inventor: Ben Utecht, Lakeville, MN (US)

( * ) Notice: Subject to any disclaimer, the term of this patent is extended or adjusted under 35 U.S.C. 154(b) by 0 days.

(21) Appl. No.: 15/226,271

(22) Filed: Aug. 2, 2016

(51) Int. Cl.
*A41B 11/00* (2006.01)

(52) U.S. Cl.
CPC ..... *A41B 11/008* (2013.01); *A41B 11/00* (2013.01); *A41B 2400/34* (2013.01); *A41B 2400/36* (2013.01); *A41B 2400/52* (2013.01); *A41B 2400/80* (2013.01)

(58) Field of Classification Search
CPC ..... A41B 11/00; A41B 13/00; A41B 11/14; A41D 10/00
USPC ..... 2/239, 80, 83, 409
See application file for complete search history.

(56) References Cited

U.S. PATENT DOCUMENTS 266,614 A * 10/1882 Bouglass ..... A41B 11/02 2/241
3,148,378 A * 9/1964 Tibbits ..... A41B 11/00 2/239
4,294,022 A * 10/1981 Stockli ..... A43B 1/10 36/4
5,592,690 A * 1/1997 Wu ..... A41B 11/00 2/113
5,617,585 A * 4/1997 Fons ..... A41B 11/007 2/239
5,697,106 A * 12/1997 Baker ..... A41B 11/00 2/22
6,275,997 B1 * 8/2001 Richardson ..... A41B 11/005 2/239
7,012,525 B1 * 3/2006 Ghioto ..... A43B 1/0045 2/239
8,156,947 B2 * 4/2012 Viola ..... A45D 29/00 132/200

* cited by examiner

*Primary Examiner* — Tejash Patel
(74) *Attorney, Agent, or Firm* — Gary L. Huusko

(57) ABSTRACT

This invention is a one-use, disposable hygienic shower sock for wearing in showers, locker rooms, or other similar areas where bare feet come into contact with damp or wet floors. The shower sock is made of a biodegradable plastic or fabric material with a water permeable upper portion and a water-proof sole. The inside of the shower sock may be treated with one or more preventative or treatment applications, such as an anti-fungal agent, an anti-bacterial agent, a plantar wart guard, a foot detox product, an anti-microbial agent, or an anti-viral agent. Essential oil based deodorizers, such as eucalyptus, peppermint, and lavender may also be applied inside the shower sock. The bottom of the sole may have an anti-slip gripping element to prevent the wearer from slipping on wet floors.

1 Claim, 4 Drawing Sheets

SHOWER SOCK

BACKGROUND OF INVENTION

Figure 1:
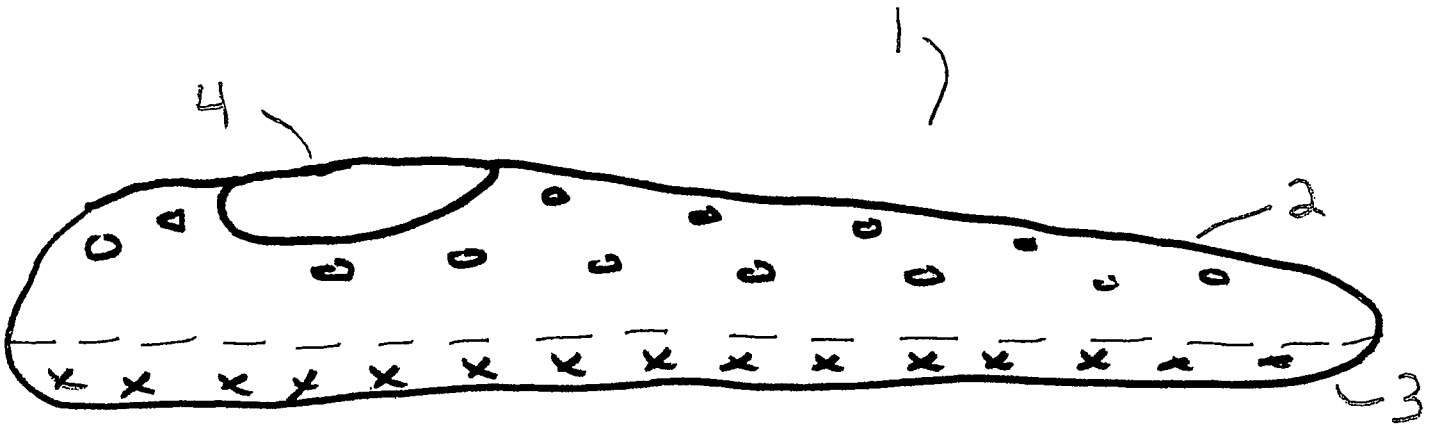

The applicant is a former professional football player and in 2008 when he was playing football for one of the professional teams in the U.S., he contracted a foot fungus from the shower facilities at the stadium where he practiced, played, and of course showered.

Unfortunately he had to see a specialist who prescribed an anti-fungal treatment which he applied to his foot for months before the fungus was finally defeated. After this experience he couldn't believe that he contracted the foot fungus from a shower facility, which was cleaned every single day. He also realized having spent a career in fitness locker rooms that there are two types of people who walk into a shower, those who wear sandals and those who proceed with bare feet. The majority walk in with bare feet because carrying wet sandals with them to the gym everyday is tedious and annoying. Unfortunately for them they take upon an unseen risk that is dangerous for their health. Out of his own personal experiences, your applicant came an idea to give people a choice to protect their feet every single time they decide to enter a shower facility any where in the world. Today your applicant spends six days a week in a local fitness club and he winces every time he walks into the steam and shower area and looks down. Due to the number of feet and the natural disposal of hair, skin, and other bodily fluids (urine etc.) the floors are typically very unclean, but patrons have no simple and efficient option to save their skin and feet from harm, let alone one that can be disposed of safely after each use. The shower sock will provide people with the peace of mind that they are protecting their feet from bacterial, fungal, and viral attacks. Your applicant needed this unique and easy to use product in his own life and after listening to the many complaints of current and former athletes they need it to.

SUMMARY OF THE INVENTION

This invention relates to a hygienic shower sock for wearing in showers, locker rooms, or other similar areas where bare feet come into contact with damp or wet floors. The shower sock is made of a biodegradable plastic or fabric material with a water permeable upper portion and a water-proof sole. The upper portion contains an elasticized opening to allow the wearer to easily slip his or her foot into the shower sock. The sole has a bottom that comprises an anti-slip gripping element to prevent the wearer from slipping on wet floors. The sole also has a top, inner portion which would be in direct contact the wearer's foot. The top, inner portion of the sole is treated with an anti-fungal agent, an anti-bacterial agent, and a plantar wart guard to protect the wearer's foot from the harmful affects of fungal, bacterial, or wart infections. Essential oil based deodorizers, such as eucalyptus, peppermint, and lavender may also be applied to the top, inner portion of the sole. Other preventative or treatment applications, such as a foot detox product, an anti-microbial agent, or an anti-viral agent may also be applied to the top, inner portion of the sole.

The shower sock is a disposable, one-use product and can be made in any size to accommodate and fit various feet sizes. The porous, water permeable upper portion allows shower water to penetrate the shower sock, mixing with the various healthful, preventative, and treatment agents on the top, inner portion of the sole, thereby bathing the foot and keeping unhealthy and unsanitary elements from infecting or otherwise coming into contact with the foot. The water-proof sole assists in keeping the water in the shower sock, and the elastic opening allows the wearer to easily insert and remove his or her foot from the shower sock.

DETAILED DESCRIPTION OF DRAWINGS

Referring to FIG. 1, the shower sock 1 is made of a biodegradable plastic or fabric material with a water permeable upper portion 2 and a water-proof sole 3. The upper portion 2 contains an elasticized opening 4 to allow the wearer to easily slip his or her foot into the shower sock.

Figure 2:
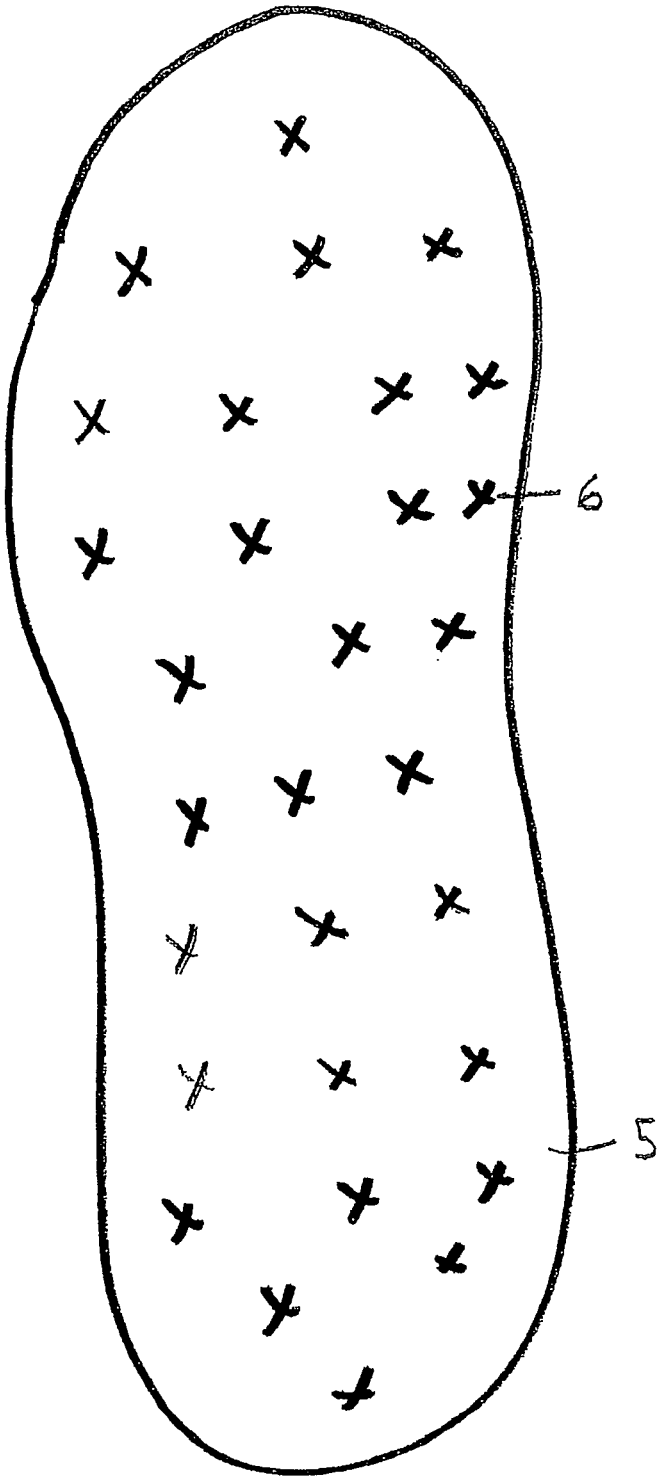

Referring to FIG. 2, the sole has a bottom 5 that comprises an anti-slip gripping element 6 to prevent the wearer from slipping on wet floors. The sole also has a top, inner portion (not shown) which would be in direct contact the wearer's foot. The top, inner portion of the sole is treated with preventative or treatment applications such as an anti-fungal agent, an anti-bacterial agent, or a plantar wart guard, or a combination of one or more of an anti-fungal agent, an anti-bacterial agent, or a plantar wart guard, to protect the wearer's foot from the harmful affects of fungal, bacterial, or wart infections. Essential oil based deodorizers, such as eucalyptus, peppermint, and lavender, or a combination of one or more of the oils, may also be applied to the top, inner portion of the sole. Other preventative or treatment applications, such as a foot detox product, an anti-microbial agent, or an anti-viral agent, or a combination of one or more of a foot detox product, an anti-microbial agent, or an anti-viral agent, may also be applied to the top, inner portion of the sole.

Figure 3:
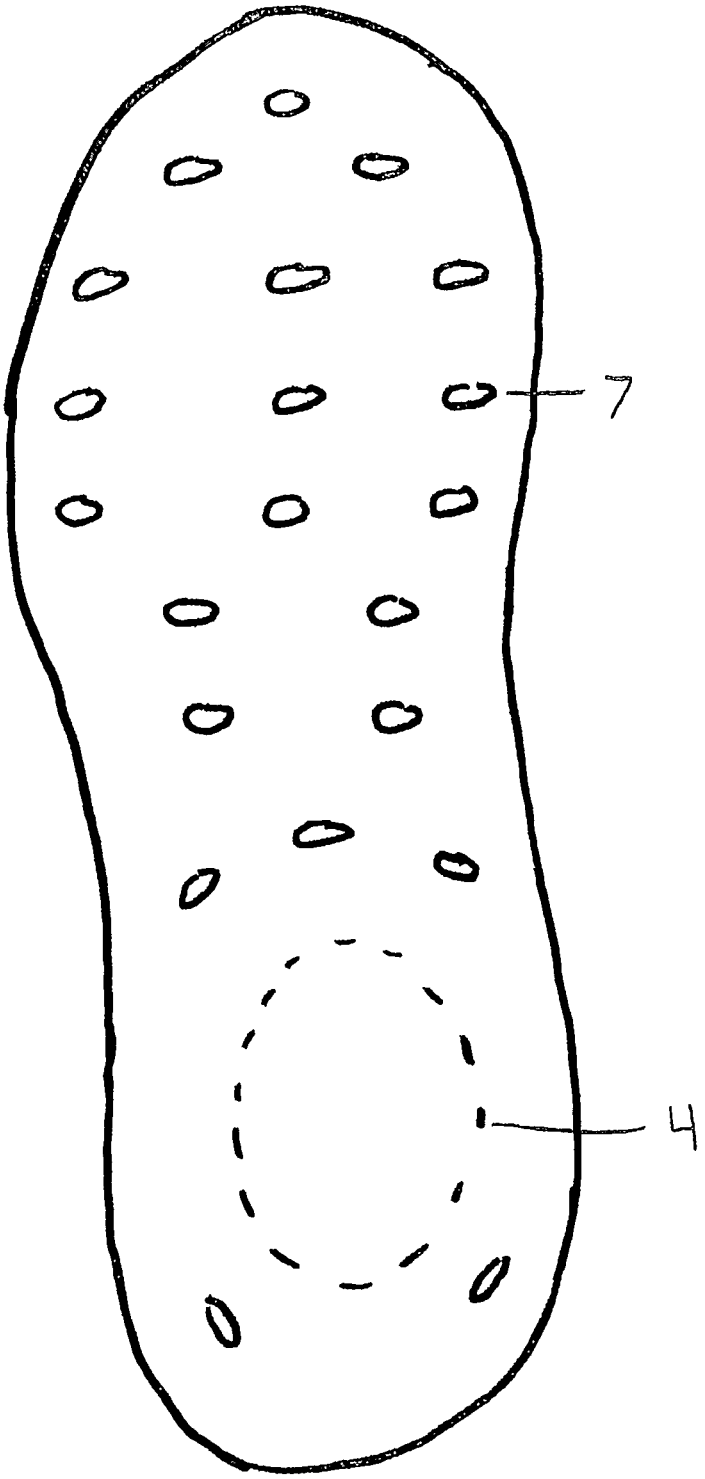

The shower sock is a disposable, one-use product and can be made in any size to accommodate and fit various feet sizes. As shown in FIG. 3, the porous, water permeable upper portion 7 allows shower water to penetrate the shower sock, mixing with the various healthful, preventative, and treatment agents on the top, inner portion of the sole, thereby bathing the foot and keeping unhealthy and unsanitary elements from infecting or otherwise coming into contact with the foot. The water-proof sole assists in keeping the water in the shower sock, and the elastic opening allows the wearer to easily insert and remove his or her foot from the shower sock.

Figure 4:
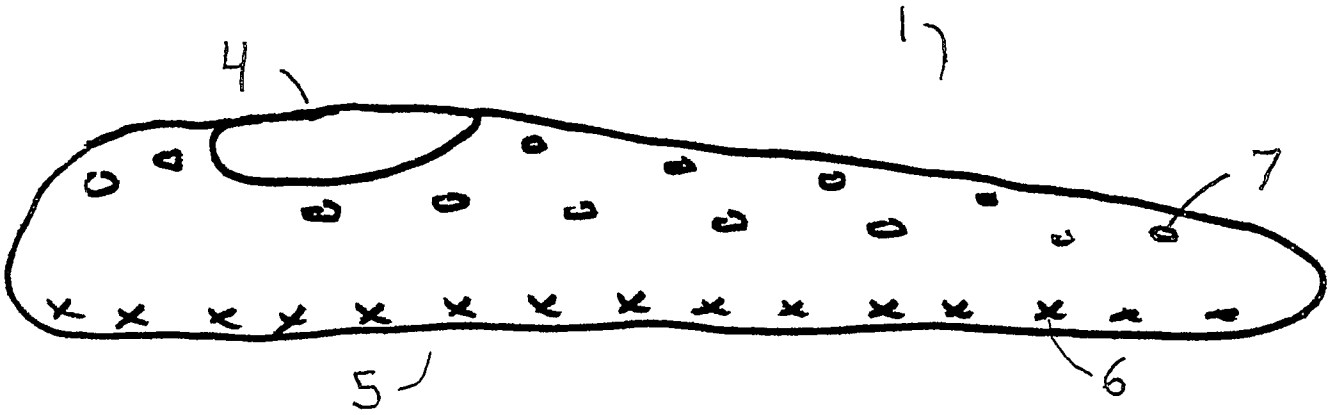

The shower sock 1 can be made out of a single piece of material, as shown in FIG. 4, with the anti-slip gripping element 6 fixedly attached to the bottom 5 of the water proof sole 3, and with holes placed throughout the upper portion 2 to create the water permeable upper portion 7.

The shower sock can also be made of two pieces of material, as shown in FIG. 1. The upper portion 2 is fixedly attached to the water proof sole 3. The means to attach the upper portion 2 to the water proof sole 3 can be glue or other adhesive means.

I claim:

1. A shower sock comprising a disposable, biodegradable material with a water permeable upper portion, a water-proof sole, and an elasticized opening in the water permeable upper portion to allow the wearer to easily slip his or her foot into the shower sock, the sole comprising a bottom and a top inner portion, the bottom comprising an anti-slip gripping element to prevent the wearer from slipping on wet floors, and the top inner portion comprising at least one health treatment application, wherein the health treatment application is a foot detox product, an anti-microbial agent, an anti-viral agent, an anti-fungal agent, an anti-bacterial agent, a plantar wart guard or an essential oil based deodorizer, wherein the essential oil based deodorizer is eucalyptus oil, peppermint oil or lavender oil.

* * * * *